United States Patent [19]

Honeycutt, III et al.

[11] Patent Number: 4,940,077

[45] Date of Patent: Jul. 10, 1990

[54] METHOD OF AND APPARATUS FOR DIRECT METAL STRIP CASTING

[75] Inventors: LeRoy Honeycutt, III; James C. Key; Herbert Moody, III, all of Salisbury, N.C.

[73] Assignee: Reynolds Metals Company, Richmond, Va.

[21] Appl. No.: 273,606

[22] Filed: Nov. 21, 1988

[51] Int. Cl.[5] ..... B22D 11/00; B22D 11/10; B22D 27/04

[52] U.S. Cl. ..... 164/463; 164/423; 164/437; 164/488; 222/594

[58] Field of Search ..... 164/463, 479, 423, 429, 164/488, 489, 136, 491, 436; 266/236; 222/294

[56] References Cited

U.S. PATENT DOCUMENTS

| | | | |
|---|---|---|---|
| 4,715,428 | 12/1987 | Johns et al. | 164/463 |
| 4,716,956 | 1/1988 | Hoffman et al. | 164/480 |
| 4,749,024 | 6/1988 | Bartlett et al. | 164/463 |
| 4,751,957 | 6/1988 | Vaught | 164/463 |
| 4,828,012 | 5/1989 | Honeycutt, III et al. | 164/429 |

FOREIGN PATENT DOCUMENTS 0147912 7/1985 European Pat. Off. .

*Primary Examiner*—Richard K. Seidel
*Assistant Examiner*—Rex E. Pelto
*Attorney, Agent, or Firm*—Lowe, Price, LeBlanc, Becker & Shur

[57] ABSTRACT

An improved method of and apparatus is disclosed for direct casting of molten metal to form a strip by solidification of the molten metal on a moving chill surface using the vessel having a floor, spaced sidewalls, an inlet and an outlet extending between the sidewalls for supplying the molten metal to the chill surface in which the transverse dimension of the outlet may be adjusted during casting to change the width of the strip and preferably adjustable baffles or flow diverters are provided to control the flow pattern to provide a substantially uniform flow of metal to the outlet.

15 Claims, 2 Drawing Sheets

METHOD OF AND APPARATUS FOR DIRECT METAL STRIP CASTING

BACKGROUND OF THE INVENTION

1. Field of the Invention

This invention relates to direct casting of metal sheet or strip in a continuous operation and more particularly to an improved method of and apparatus for accelerated casting of thin metal strip by withdrawing the strip in a continuous operation from a supply of molten metal on a chilled casting surface.

2. Prior Art

The conventional practice of forming thin metal sheet by initially casting the metal as an ingot, a thick slab or a plate and subsequently rolling the cast metal into an elongated strip of the desired thin gauge is an expensive and time consuming operation. Accordingly, substantial effort has been directed in recent years to developing a process for directly casting molten metal into a continuous thin strip. One system which has been developed and which is now in commercial use for the production of aluminum sheet casts the metal as a continuous strip on the outside surface of a chilled, driven cylindrical drum. A layer of the molten metal is typically delivered to the chilled casting surface by means of a tundish which is open at one end with the open end being positioned closely adjacent to and mating with the cylindrical casting surface. A tundish and driven cylindrical casting wheel suitable for use in such a strip casting process is disclosed in copending U.S. application Ser. No. 07/179,536, now Pat. No. 4,828,012, the disclosure of which is incorporated herein by reference. In such a system, it is critical to the production of strip of uniform thickness and surface characteristics that the molten metal flowing through the tundish be presented to the chill surface at a substantially uniform temperature across the full width of the strip to be cast. The term "strip" as used herein is intended to mean relatively wide sheet metal in a continuous running length but not to include the narrow continuing ribbon such as is frequently formed in the continuous casting of amorphous metal ribbon which may be only two or three centimeters in width.

A cylindrical chill casting wheel used in the system just described may have an axial length sufficient to produce any desired width of strip within the limits of the apparatus. It has been the practice, however, to utilize a tundish having a transverse width at its outlet or open end which is equal to the desired width of strip to be cast during any particular run. This enables the design and location of baffles, submerged weirs, diffusers and the like to produce the desired uniform flow rate and temperature at the tundish outlet as described in the above-identified copending application. This makes it necessary to stop the process, remove the existing tundish and install a new tundish when it is desired to cast a strip of a different width. This is not only a time consuming operation, but also requires a separate tundish for every width which may be cast, with each tundish being designed and constructed to produce the desired uniform flow. Further, interrupting the casting process results in substantial waste material both as a result of material remaining in the tundish at the end of a run and at the next startup. In addition, and depending upon the length of down time, this procedure may require surface conditioning and maintenance of the cylindrical casting surface.

U.S. Pat. No. 4,751,957 discloses a continuous strip casting apparatus including an air knife employed to assist in the control of strip thickness. Again, a tundish of fixed dimensions is used so that no provisions are made for changing strip width during operation.

U.S. Pat. Nos. 4,715,428 and 4,749,024 and European published application No. 0147912 disclose further tundish configurations for use in direct strip casting. None of these tundish designs provide any means for changing the width of the strip being cast during the casting operation.

SUMMARY OF THE INVENTION

It is an object of the present invention to provide an improved method of and apparatus for the direct casting of metal sheet in continuous strip form.

It is another object of the invention to provide such a method and apparatus wherein the width of the strip being cast may be changed without interrupting the casting operation.

It is another object of the invention to provide such a process and apparatus wherein the width of the strip being cast may be changed while maintaining a substantially uniform metal temperature and flow rate across the full width of the tundish adjacent to the chill surface.

In the attainment of the foregoing and other objects and advantages of the invention, an important feature resides in providing a tundish of the type having a back wall, opposed sidewalls and a floor, with the floor and sidewalls terminating in an outlet closely adjacent to and contoured to fit closely with a driven chill casting surface. The sidewalls of the tundish at the chill surface are spaced apart a distance equal to the maximum width of strip to be cast, and means are provided for effectively reducing the distance between the opposed inner surfaces of the sidewalls at the chill surface to produce a more narrow strip.

The means for adjusting the distance between the opposing sidewall surfaces may be in the form of a plurality of removable inserts which can be installed on the inner surface of the sidewalls adjacent the chill surface during operation of the apparatus and without interrupting the casting process. One or more inserts may be installed and/or removed on one or both sidewall inner surfaces to produce the desired strip width. The portion of each insert which is adjacent the chill is contoured to cooperate with the moving chill surface to prevent leakage of the molten metal, and means are provided to accurately position the respective inserts and to retain the inserts in the installed position during operation.

The tundish is also provided with adjustable or movable baffles or other means to compensate for any flow pattern change resulting from the insertion or removal of the width changing inserts. Such adjustable or movable baffle means may take various forms including baffles or flow guides which may be inserted in or removed from fixed support brackets, or adjustable vanes or guides which may be laterally shifted or axially rotated to influence the flow of molten metal to the tundish outlet lip. Both computer modelling and water modelling, as well as experimental casting runs, may be employed to calibrate the adjustable baffling in coordination with various combinations of width changing inserts to facilitate width changing during commercial production of metal strip.

BRIEF DESCRIPTION OF THE DRAWINGS

The foregoing and other features and advantages of the invention will be apparent from the detailed description contained hereinbelow, taken in conjunction with the drawings, in which.

DESCRIPTION OF THE PREFERRED EMBODIMENTS

Figure 1:
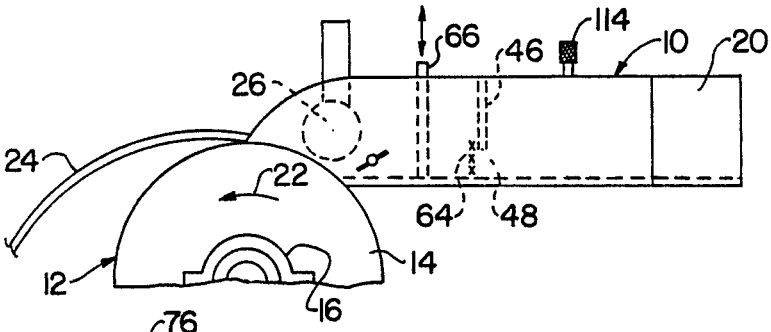
FIG. 1 is a fragmentary schematic view, in elevation, of a direct strip casting apparatus embodying the present invention.

A direct strip casting apparatus suitable for use in practicing the present invention is schematically shown in FIG. 1 of the drawings. As illustrated, a tundish 10 is located in close proximity to a chill surface 12 of a casting wheel 14 supported for rotation about a horizontal axis by journal bearings 16. Molten metal is supplied to the tundish via a submerged inlet 18 (see FIG. 2) from a surge chamber 20 which, in turn, is supplied by suitable means such as a ladle, not shown. Molten metal in the tundish contacts the chill surface 12 as the wheel 14 is rotated in the direction of arrow 22 to be solidified to form a continuous strip 24 which is withdrawn from the casting apparatus and coiled in a conventional manner by a suitable coiler, not shown.

Casting wheel 14 is internally cooled with a circulating fluid such as water to rapidly extract heat through the chill surface 12 to quench and solidify the molten metal withdrawn from the tundish as the casting wheel rotates upward through the molten metal. The chill surface 12 is preferably roughened or grooved and is conditioned to maintain a substantially smooth uniform natural oxide coating on the surface which contacts the molten metal as described in copending application Ser. No. 07/263,074, filed Oct. 27, 1988, and assigned to the assignee of the present application. The casting apparatus may also include a top roll 26 mounted for rotation in contact with the molten metal forming the strip, with the top roll being maintained at a temperature to permit at least a film of molten metal to pass beneath its surface. Details of the top roll process and apparatus are disclosed and claimed in copending U.S. application Ser. No. 07/152,486, filed Feb. 5, 1988, and assigned to the assignee of the present application.

Figure 2:
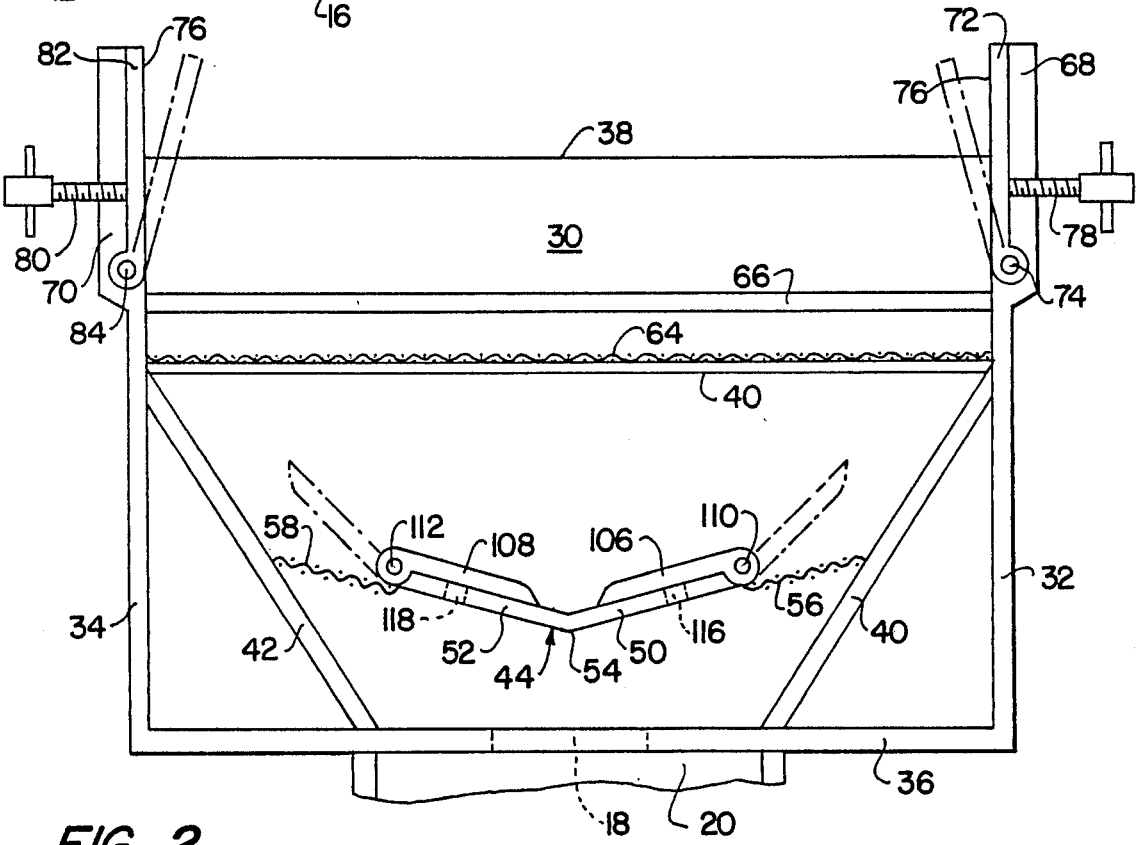
FIG. 2 is a top plan view of the tundish structure shown in FIG. 1.
Figure 3:
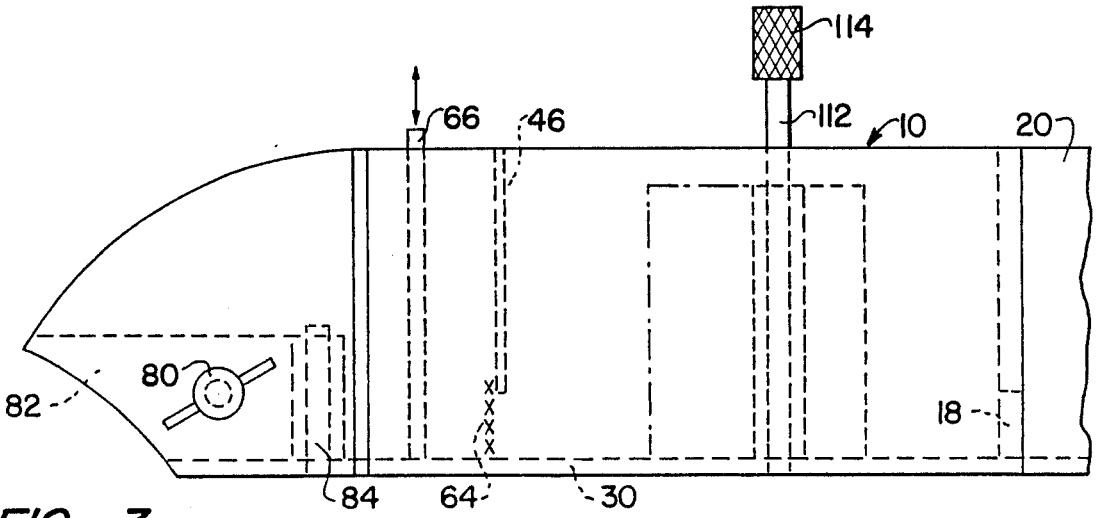
FIG. 3 is a fragmentary side elevation view, on an enlarged scale and with portions broken away, of the structure shown in FIG. 2.

Referring now to FIGS. 2 and 3, the tundish 10 includes a floor 30, laterally spaced upwardly extending opposed, generally parallel sidewalls 32 and 34, a rear end wall 36, an open top and an open end which is effectively closed by the chill surface 12. Floor 30 has a contoured end or lip 38 generally conforming to and spaced closely adjacent the surface 12 to prevent molten metal from leaking during casting. A pair of diverging wall members 40, 42 have one end connected to end wall 36, one on each side of the opening 18, with wall 40 extending to and being joined with sidewall 32 and wall 42 extending to and being joined with sidewall 34. Walls 40, 42 thus cooperate to define an outwardly diverging molten metal chamber extending from the inlet 18 and to eliminate areas at the back corners of the tundish defined by the end wall and sidewalls where stagnant metal could freeze.

Figure 4:
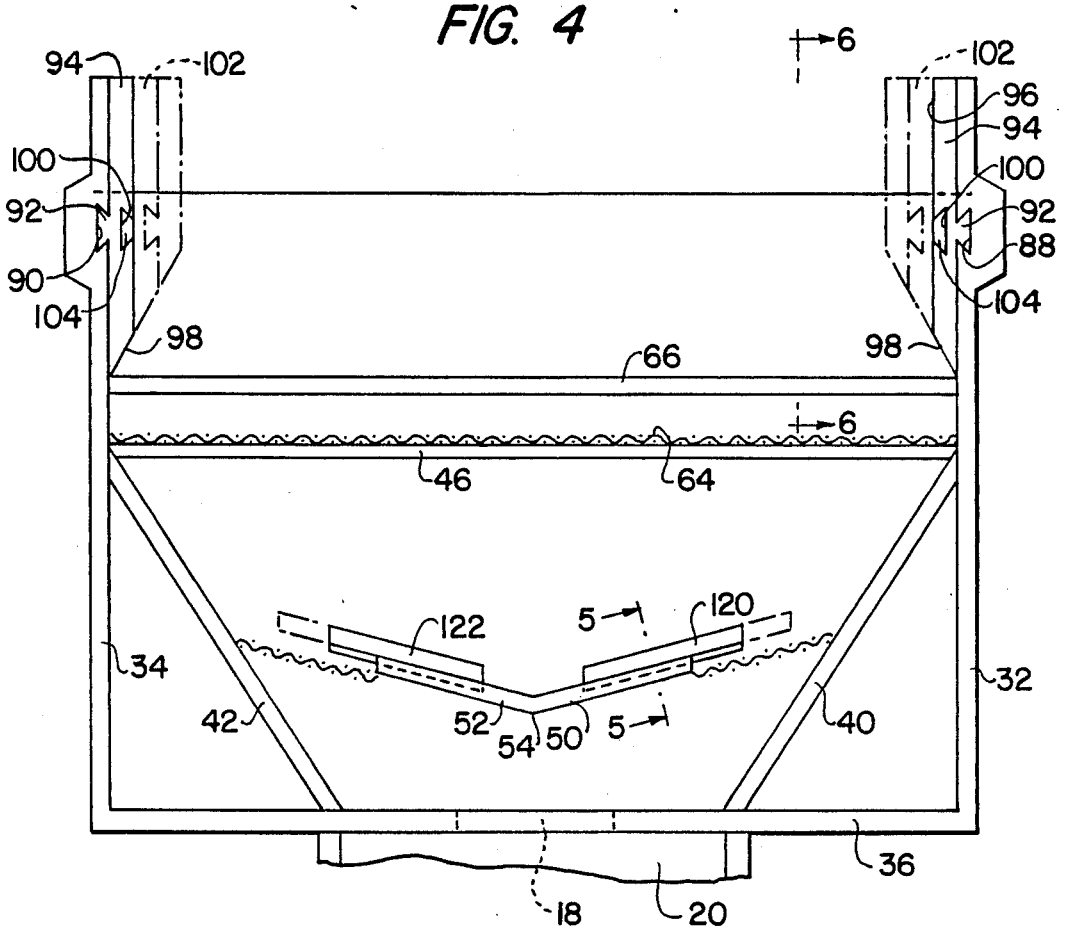
FIG. 4 is a top plan view similar to FIG. 2 and showing an alternate embodiment of the invention.

Metal flow dividing, diverting and diffusing means are provided in the tundish to reduce channeling and produce a more uniform flow rate and temperature of molten metal delivered to the tundish lip 38. This facilitates control both of strip gauge and of the transverse shape of the formed strip by enabling a more uniform heat transfer through the chill surface. As best seen in FIGS. 2 and 4, the molten metal dividing and diverting means includes a central baffle 44 which cooperates with the diverging walls 40, 42 to divide the flow stream entering through submerged inlet 18 into two outwardly directed streams, and a flow restricting wall or dam 46 which extends completely across and is spaced above the top surface of floor 30 to present a submerged opening 48 through which molten metal must flow to reach the lip 38.

The central baffle 44 may include a pair of planar plates 50, 52 having one vertical edge joined together along a common line or apex 54, with plates 50, 52 extending in angled relationship to form a Chevron or V-shaped structure terminating in spaced relation to the diverging walls 40, 42 to provide a pair of laterally spaced flow passages around the central baffle. A pair of flow diffuser screens 56, 58 extend one between the free edge of baffle plate 50 and the diverging wall 40 and the other between the free edge of baffle plate 52 and the wall 42. Diffusers 56, 58 are preferably formed from a refractory or suitable material capable of withstanding the temperature of the molten metal to be cast and are provided with a uniform pattern of small openings to divide and diffuse the flow of metal passing through the space between the central baffles and the opposed diverging walls. For casting of aluminum strip, a woven screen formed from a fiberglass material has been found to provide the desired diffusion and to withstand the temperature and fluid pressure, as well as to resist the erosive effect of the flowing metal to thereby provide a very satisfactory diffusion material. Further, such a screen having a mesh of about ⅛ inch, for example, provides the additional function of retarding the flow of oxides or slag on the surface of the metal.

The transverse wall or dam 46 is positioned downstream of the diverging walls 40, 42, and of the central baffle 44, and has its bottom edge extending in vertically spaced relation to the top surface of floor 30. The opening 48 between the floor and the bottom edge is preferably slightly less than the depth of liquid metal downstream of wall 46 during the casting operation, and a third diffuser 64, again preferably in the form of a screen-like material, extends over the opening 48 between the floor 30 and the bottom edge of dam 46 to provide uniform flow diffusion across the transverse width of the tundish during casting operations. The screen 64 will also act as a flow restricter which, in combination with the positioning of the wall 46 with its bottom edge below the surface of the metal during casting, results in the depth of metal, on the upstream side of the wall being greater than downstream so that the wall 46 acts as a skimmer, holding back oxides and slag floating on the surface of the molten metal and producing a head differential across the screen 64. This head differential results in a substantially uniform, diffused flow of metal from beneath the oxide layer upstream of wall 46, producing a light turbulence in the form of small eddies which diffuse flow to prevent the channeling of molten metal and thereby provide a more uniform flow and consequent uniform temperature across the width of the tundish at the lip 38. Turbulence produced by the diffusing screens, however, is not great enough to cause mixing of floating oxide, slag, dross or other impurities with the liquid metal flowing through the tundish.

A flow control gate 66 is mounted for vertical sliding movement between the sidewalls 32, 34 downstream of dam 46. Gate 66 is adapted to be moved from a lowered position in which its bottom edge engages the top surface of floor 30, completely preventing the flow of metal to the contoured lip 38, and a raised position out of contact with the molten metal to permit free flow, by gravity, downstream of the wall 46.

In accordance with the present invention, means are provided for enabling the tundish just described to be employed in the casting of strip of different widths, within limits. To accomplish this, in the embodiment of FIGS. 2 and 3, wall 32 is offset outwardly in the area downstream from gate 66 as shown at 68 and sidewall 70 is offset in the opposite direction as shown at 70. A first movable wall element 72 is supported for pivotal movement about a vertical hinge pin 74 at the offset 68, with its inwardly directed surface 76 normally being disposed in a common plane with the inwardly directed surface of sidewall 32. The forwardly directed end of movable wall member 72 is contoured to conform with the surface 12 of the cylindrical chill 14 and to cooperate therewith to provide an effective seal for the molten metal during the casting operation. A jack screw 78 extends horizontally through a threaded opening in offset wall portion 68 and bears against the outwardly directed surface of the movable element 72 to pivot the wall member 72 about its vertical hinge pin 74 from the straightline position to the broken line position shown in FIG. 2. A similar jack screw 80 extending through a threaded opening in wall offset 70 bears against a second movable wall member 82 to pivot such movable wall member about a second vertical hinge pin 84. Thus, when it is desired to reduce the width of strip being cast with the tundish from the maximum possible width shown in full line in FIG. 2, one or both the jack screws 78, 80 are turned to pivot the movable wall members 72, 82 inward, effectively reducing the width of the tundish at the lip 38.

Figure 5:
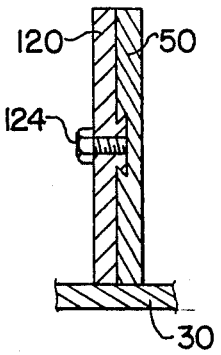
FIG. 5 is a fragmentary sectional view taken on line 5—5 of FIG. 4.
Figure 6:
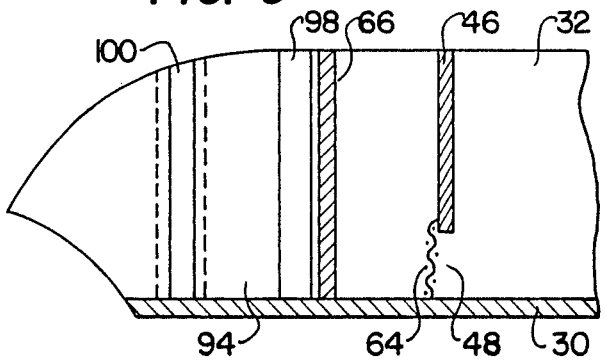
FIG. 6 is a fragmentary sectional view taken on line 6—6 of FIG. 4.
Figure 7:
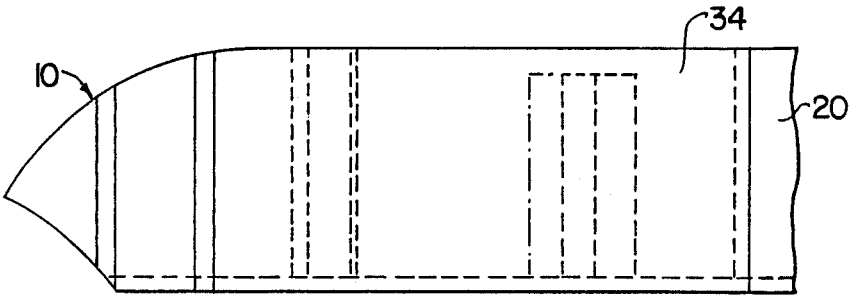
FIG. 7 is a side elevation view of the structure shown in FIG. 4.

An alternate arrangement for reducing the effective width of the tundish 10 at its outlet, and thereby reduce the width of strip cast using the tundish, is illustrated in FIGS. 4–6. In this embodiment, sidewall 32 is provided with a vertically extending dovetail mortise or groove 88 in its inner surface at a location adjacent lip 38, and a similar groove 90 is formed in wall 34 in opposing relation to groove 88. Mortise 88 is adapted to receive a tenon 92 on a platelike width changing adapter 94 to accurately but releasably retain the adapter 94 in position on the inner surface of sidewall 32 at the tundish outlet. As seen in FIG. 6, the adapter plate 94 has a bottom edge which, when installed, is in contact with the top surface of floor 30, and a forwardly directed contoured edge 96 shaped to fit in closely spaced relation to the cylindrical chill surface 12 to form a seal preventing molten metal from escaping laterally. The rearwardly directed vertical edge 98 of the adapter plate 94 is tapered or inclined to the inner surface of sidewall 32 to present minimum obstruction to flow of molten metal through the tundish.

Adapter plate 94 preferably also has a dovetail-shaped mortise or groove 100 on its inwardly directed surface for receiving a tenon on a second adapter plate illustrated in broken line at 102. When such second adapter plate is not employed, an insert 104 may be mounted within the mortise 100 to present a smooth inner surface for the adapter plate and to prevent molten metal from flowing into the mortise and possibly freezing. As shown in broken lines in FIG. 4, additional adapter plates may be employed in like manner. Similarly, one or more adapter plates, which are mirror images of the adapter plates just described, may be mounted on the inner surface of sidewall 34 to produce the desired width of strip. Since the configuration, mounting and function of the adapter plates used on opposed sides of the tundish are substantially identical, the adapters mounted on wall 34 will not be described and corresponding reference numerals are employed to designate like parts on both sides of the tundish.

As indicated above, in order to produce directly cast metal strip of substantially uniform thickness and of uniform transverse shape, it is necessary to maintain the flow of molten metal to the lip 38 at a substantially uniform temperature across the full width of the tundish. To obtain the desired uniformity of temperature, a substantially uniform flow rate is also required, or means for compensating for slight variations may be employed such as contouring the tundish floor at the lip as described in the above-identified copending application Ser. No. 07/179,536. It is apparent, however, that the flow pattern for any tundish design will be altered at least to some extent by any structure which reduces the effective width of the tundish at the discharge lip. Accordingly, means are also provided for altering the flow pattern to the tundish upon affecting any width change, whether by use of the movable wall structure shown in FIGS. 2 and 3 or by use of the plate adapters shown in FIGS. 4–6.

One means of altering the flow pattern to the tundish is illustrated in FIGS. 2 and 3 as including a pair of movable baffle members or plates 104, 106, respectively, mounted on the distal ends of central baffle plates 50, 52 respectively, by vertical hinge pins 110, 112. The movable baffle members may be rotated from the full line position shown in FIG. 2 overlying the back surface of baffle plates 50, 52 to any desired position such as those shown in broken lines in FIG. 2. To accomplish this, a suitable manually actuated control knob or crank, illustrated in FIGS. 1 and 3 at 114, is provided on the top end of the hinge pins. By providing a tight friction fit around the hinge pins, the movable baffle members will be retained in the desired position of adjustment since little force is applied by the relatively shallow, low velocity stream of molten metal passing through the tundish. Suitable latching means may, however, be provided if desired.

Baffle plates 50 and 52 may be provided with one or more submerged openings such as shown at 116, 118, and preferably such openings are covered by a refractory diffusion screen such as employed at 64. Such openings preferably are positioned to be closed by the movable baffle members 106, 108 in the full line position as shown in FIG. 2. However, when the width of strip to be cast is reduced as by adjusting the movable wall members 72, 82 toward the broken line position of FIG. 2, it may be desired to provide an increased flow in the center portion of the tundish, and this is accomplished by shifting the movable baffle members 106, 108 to uncover the openings 116, 118. The position of movable baffles 106, 108 will, of course, influence the flow pattern through the tundish and may be adjusted as required to establish and maintain the desired uniform temperature at the outlet lip 38.

An alternate embodiment of adjustable baffle means is shown in FIGS. 4 and 5 wherein a horizontal dovetail mortise or groove is provided in the downstream surfaces of fixed baffle plates 50, 52, respectively, and movable baffle plates 120, 122, each having a dovetail tenon on its upstream side disposed within the complementary mortise is supported for sliding movement to vary the transverse width of the flow channels around the ends of the fixed baffle. Suitable means such as a set screw 124 may be provided to releasably lock the movable baffle plates in the desired position of adjustment.

In operation of the apparatus according to the present invention, the tundish width, i.e., the distance between sidewalls 32, 34, is selected for the widest strip to be cast using the apparatus. The position of the adjustable baffle members on the central baffle are positioned in the full line position when employing the embodiment of FIGS. 2 and 3, and the apparatus operated in the normal manner. However, when it is desired to make limited reductions in the width of strip to be cast, it is not necessary to interrupt the casting operation as in the past. Instead, such limited width change is accomplished simply by turning the jack screws 78, 80 to pivot the movable wall members 72, 82 toward one another until the desired strip reduction is achieved. It is noted, however, that the pivoted wall members can only be employed to effect a limited strip width reduction since such pivotal movement will tend to increase the spacing between the chill surface and the end of the movable wall member. Thus, as a practical matter, the movable members can not be pivoted to the point beyond which a seal is maintained and this amount of pivotal movement will, of course, vary with the distance between the hinge pins 74, 84 and the outlet edge 38. The greater the distance between lip 38 and the hinge pins, the greater the strip reduction which can be effected using this embodiment.

In the alternate embodiment of the invention shown in FIGS. 4–6, the number and thickness of the removable adapter plates 94, 102 will be selected to produce the desired width change. The adapter plates may be dropped into place without interruption of the casting operation. The importance of this feature is apparent when it is recognized that molten metal can be retained in the tundish for only a very limited time without freezing, and any freezing disrupts metal flow, thereby requiring extensive downtime.

After the width adjustment is made, it may be necessary for the adjustable baffle means to be repositioned to produce the desired flow pattern change to compensate for the reduced tundish outlet width.

It should be apparent that the present invention not only permits decreasing the width of a strip during casting, from a maximum width defined by the spacing of the sidewall inner surfaces at the tundish outlet, but also that the width may be selectively increased or decreased within the limits of the apparatus during operation. Also, while reference has been made to changing the strip width, or changing the transverse dimension of the tundish outlet during the casting operation, such width changes in practice will require very little time and it is conceivable that flow through the tundish may be momentarily interrupted, as by lowering the flow control gate 66 to produce a break in the strip as the outlet width is being changed. By reestablishing the molten metal flow through the tundish so quickly as not to permit any substantial temperature change of metal contained in the tundish, casting of a second strip of a different width c an quickly be started. Since difficulty is sometimes encountered in immediately establishing contact of the metal across the full width of the tundish, however, it is preferred to make the width changes without interrupting the casting operation.

While different embodiments of the invention have been disclosed and described for accomplishing a change in the space between the inner surfaces of the sidewalls which define the tundish outlet and for affecting flow path changes, numerous other arrangements could be employed. Further, it should be apparent that various devices including power actuating means and clamping means may be provided for positioning and retaining the movable wall members and the movable or adjustable baffle means. Accordingly, while preferred embodiments of the invention have been disclosed and described, it should be understood that it is not intended to be limited to the disclosed embodiments but rather that it is intended to include all embodiments which would be apparent to one skilled in the art and which come within the spirit and scope of the invention.

What is claimed is:

1. An open tundish for flowing molten metal directly onto a single moving chill surface for direct casting of a running length of thin metal strip of predetermined width, the tundish comprising a bottom wall, opposed sidewalls, an end wall having an inlet for admitting a stream of molten metal, an open end opposite said end wall providing an outlet for free flowing of molten metal onto the moving chill surface in a stream having a transverse width equal to the predetermined width for solidification from said chill surface to form a strip, and strip width adjusting means for changing the width of strip being cast, the strip width adjusting means including means for changing the transverse dimension of said tundish open end at said outlet during strip casting to thereby change the width of the stream of molten metal flowing onto the moving chill surface.

2. The tundish defined in claim 1 wherein said strip width adjusting means comprises movable wall means defining a portion of the inner surface of at least one of said sidewalls adjacent said outlet.

3. The tundish defined in claim 2 further comprising baffle means in the path of said stream of molten metal, said baffle means including movable means for altering the flow pattern through said tundish.

4. The tundish defined in claim 3 further comprising actuator means connected with said movable means, said actuator means being selectively operable to change the position of said movable means to thereby alter said flow pattern.

5. The tundish defined in claim 4 further comprising flow diffusing means in said vessel in the path of molten metal flowing therethrough, said diffusion means cooperating with said baffle means to produce a substantially uniform flow of molten metal to said outlet through its transverse width.

6. The tundish defined in claim 1 wherein said strip width adjusting means comprises sidewall adapter means and means releasably mounting said sidewall adapter means in position in the tundish in contact with said bottom wall and with said at least one sidewall adjacent said outlet, said adapter means defining the inner surface of said sidewall when mounted in said tundish.

7. The tundish defined in claim 6 wherein said strip width adjusting means comprises a plurality of sidewall adapters, each adapted to be mounted in said tundish at each said sidewall adjacent said outlet, said plurality of sidewall adapters being adapted to be selectively mounted in or removed from the tundish individually or in groups, each said sidewall adapter being in the form of a generally flat plate member having one edge contoured to conform to the moving chill surface and cooperating therewith when mounted in said tundish to form a seal for the molten metal.

8. The tundish defined in claim 7 wherein each said plate member comprises an upstream edge tapered to minimize turbulence when mounted in the tundish.

9. The tundish defined in claim 8 further comprising baffle, means in the path of said stream of molten metal, said baffle means including movable means for altering the flow pattern through said tundish.

10. The tundish defined in claim 9 further comprising actuator means connected with said movable means, said actuator means being selectively operable to change the position of said movable means to thereby alter said flow pattern.

11. The tundish defined in claim 10 further comprising flow diffusing means in said vessel in the path of molten metal flowing therethrough, said diffusion means cooperating with said baffle means to produce a substantially uniform flow of molten metal to said outlet through its transverse width.

12. In a process for direct casting of molten metal to form strip by solidification of molten metal on a single moving chill surface using a tundish having a floor, spaced sidewalls, an open top, an inlet and an open end defining an outlet extending between and having a transverse width defined by the inner surface of the sidewalls for supplying the molten metal in a free flowing stream to the chill surface, the process including the steps of positioning the tundish with its open end adjacent the chill surface, providing a source of molten metal to be cast, and widthdrawing a stream of molten metal from the source and flowing the stream through the tundish to the outlet for free contact with the moving chill surface, the improvement comprising the steps of changing the width of strip being cast by changing the distance between said inner surfaces of said sidewalls at said outlet during the casting process.

13. The process defined in claim 12 wherein the steps of changing the distance between said inner surfaces comprises the step of providing a plurality of adapters each adapted to be mounted in the tundish adjacent said inner surface of said sidewalls and in contact with said floor, and selectively installing one or more of such adapters in said tundish or removing such adapters from the tundish to provide the desired width of said outlet.

14. The process defined in claim 13 wherein said tundish further includes movable baffle means in the path of the stream of molten metal flowing through the tundish, the process further comprising the step of moving said movable baffle means to provide a substantially uniform flow of molten metal to said outlet substantially across its full width upon changing the distance between said inner surfaces of said sidewalls.

15. In a tundish for use in direct casting of molten metal to form strip by solidification of molten metal on a moving chill surface, comprising:

a vessel including a floor, first and second opposed sidewalls, and an outlet having a transverse discharge surface for flowing a stream of molten metal onto the moving chill surface;

means providing a source of molten metal to be cast;

baffle means in the vessel;

inlet means for directing a flow of molten metal from the source into the vessel in a direction to impinge on said baffle means to be deflected thereby; and means for diffusing the composite stream to form an outlet stream of substantially uniform depth and velocity throughout its width, the improvement wherein said baffle means comprises movable baffle wall means, and actuator means selectively operable to move said movable baffle wall means to thereby control the flow path of molten metal through the tundish.

* * * * *